US010533819B2

(12) United States Patent
Thomas

(10) Patent No.: US 10,533,819 B2
(45) Date of Patent: Jan. 14, 2020

(54) SUPPRESSOR FOR FIREARMS

(71) Applicant: Gerald R. Thomas, Clermont, FL (US)

(72) Inventor: Gerald R. Thomas, Clermont, FL (US)

( * ) Notice: Subject to any disclaimer, the term of this patent is extended or adjusted under 35 U.S.C. 154(b) by 0 days.

(21) Appl. No.: 16/022,968

(22) Filed: Jun. 29, 2018

(65) Prior Publication Data

US 2019/0017768 A1 Jan. 17, 2019

Related U.S. Application Data

(63) Continuation-in-part of application No. 15/467,322, filed on Mar. 23, 2017, now abandoned.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/28; F41A 21/32; F41A 21/325; F41A 21/34; F41A 21/36; F41A 21/38
See application file for complete search history.

(56) References Cited

U.S. PATENT DOCUMENTS 748,157 A * 12/1903 Bouton ..... F01N 1/084 181/265
819,834 A * 5/1906 Zalinski ..... F41A 1/06 89/14.05
851,490 A * 4/1907 Brisben ..... F01N 1/14 181/263
956,717 A * 5/1910 Moore ..... F41A 21/30 181/223
1,017,003 A * 2/1912 Kenney ..... F41A 21/30 181/223
1,140,578 A * 5/1915 Coulombe ..... F41A 21/30 181/223
1,229,675 A * 6/1917 Thompson ..... F41A 21/30 89/14.3
1,487,312 A * 3/1924 Bull ..... F41A 21/34 123/198 R
1,605,864 A * 11/1926 Steinegger ..... F41A 21/30 181/223
1,736,319 A * 11/1929 Maxim ..... F01N 1/06 181/267

(Continued)

*Primary Examiner* — Derrick R Morgan
(74) *Attorney, Agent, or Firm* — John V. Stewart

(57) ABSTRACT

A conduit (5) with a bullet passage (13, 17) extends forward from a gun muzzle (7). Inner and outer concentric chambers (25, 29) surround the conduit and a forward portion of the barrel (3). A gas path (P2, P3, P4) is provided through sides of the conduit into the inner chamber, thence to the outer chamber, and then exits to the atmosphere at the front of the outer chamber. Each chamber has longitudinal lines of sight between front and back sound reflectors (R1-R2, R3-R4), and no longitudinal line of sight from the back reflector (R2, R4) to the atmosphere. The gas path through the suppressor is at least 6 times less flow-restrictive than the gas path through the bullet exit (17) or back into the barrel bore (4), minimizing backpressure. The gas path (P3) between the inner and outer chambers is through apertures (33) limited to a lengthwise middle portion of an inner shell (21) that divides the chambers (25, 29).

20 Claims, 3 Drawing Sheets

(56) References Cited

U.S. PATENT DOCUMENTS 2,101,849 A * 12/1937 Green ..... F41A 13/12 181/223
2,112,831 A * 4/1938 Cutts, Jr. ..... F41A 21/34 89/14.3
2,128,936 A * 9/1938 Green ..... F41A 13/12 89/14.1
2,351,037 A * 6/1944 Green ..... F41A 21/34 89/14.5
2,503,491 A * 4/1950 Janz ..... F41A 21/30 181/223
2,514,996 A * 7/1950 Faust, Jr. ..... F41A 21/30 181/223
2,916,970 A * 12/1959 Mutter ..... F41A 21/00 89/14.3
4,291,610 A 9/1981 Waiser
4,974,489 A * 12/1990 Fishbaugh ..... F41A 21/30 89/14.4
6,575,074 B1 * 6/2003 Gaddini ..... F41A 21/30 89/14.4
8,286,750 B1 * 10/2012 Oliver ..... F41A 21/30 181/223
8,464,625 B2 * 6/2013 Polovnev ..... F41A 21/34 89/14.2
8,671,818 B1 3/2014 Oliver
8,826,793 B2 9/2014 Oliver
8,875,612 B1 * 11/2014 Klett ..... F41A 21/30 89/14.4
9,080,829 B1 * 7/2015 Cellini ..... F41A 21/36
9,347,727 B1 * 5/2016 Cler ..... F41A 21/30
9,476,662 B2 10/2016 Fischer et al.
9,500,427 B1 * 11/2016 Larue ..... F41A 21/30
9,658,018 B1 * 5/2017 Heckert ..... F41A 21/30
10,048,033 B1 * 8/2018 Lee ..... F41A 21/34
10,126,084 B1 * 11/2018 Oglesby ..... F41A 21/30
10,180,299 B2 * 1/2019 Morreau ..... F41A 21/34
2012/0180624 A1 * 7/2012 Troy ..... F41A 21/30 89/14.4
2013/0319790 A1 12/2013 Bladen
2014/0216237 A1 * 8/2014 Butler ..... F41A 21/36 89/14.4
2014/0299405 A1 * 10/2014 Miller ..... F41A 21/30 181/223
2015/0135935 A1 * 5/2015 Schoenlau ..... F41A 21/30 89/14.4
2016/0123689 A1 5/2016 Maeda
2017/0023326 A1 * 1/2017 Wilson ..... F41A 21/38
2017/0205175 A1 * 7/2017 Garst ..... F41A 21/30
2017/0254609 A1 * 9/2017 Schoenlau ..... F41A 21/32
2018/0038663 A1 * 2/2018 Larue ..... F41A 3/66
2018/0058791 A1 * 3/2018 Larue ..... F41A 21/325
2018/0135932 A1 * 5/2018 Tomczak ..... F41A 21/30
2018/0252489 A1 * 9/2018 Parker ..... F41A 21/30
2018/0274873 A1 * 9/2018 Thomas ..... F41A 21/30
2019/0017768 A1 * 1/2019 Thomas ..... F41A 21/30

* cited by examiner

SUPPRESSOR FOR FIREARMS

FIELD OF THE INVENTION

This invention relates to suppressors for firearms, and particularly to sound suppressors that minimize back pressure and minimize extension of the suppressor forward of the muzzle.

BACKGROUND OF THE INVENTION

Sound suppressors on firearms create backpressure that causes some of the propellant gas in the suppressor to flow back into the barrel and gas system after the bullet exits. This contaminates the barrel with solids, and can affect operation of the receiver due to contamination and departure from the design backpressure. Current suppressors maintain high pressures in the bore and gas systems longer than the system was designed to handle. This causes timing issues with the gas system that result in high stresses, accelerated wear, damaged extractors and cases, etc. An entire cottage industry has grown to provide adjustable gas blocks to address these shortcomings. Shorter barrels may be more affected. For example a suppressor that works on a 20-inch barrel may impair the repeating mechanism of a rifle with 14.5-inch barrel. Therefore, a need exist for an effective sound suppressor with reduced back pressure. Current suppressors cause high backpressure because they try to contain the blast, preventing it from flowing through the suppressor. They only absorb a small percentage of gas volume before the gas compresses and flow ceases. Another disadvantage of prior suppressors is that they make the gun longer by extending forward of the barrel.

SUMMARY OF THE INVENTION

The present invention is a suppressor that reduces or eliminates the backpressure of prior suppressors while providing high effectiveness according to acoustics testing by the inventor. The gas flow path through the suppressor is much less flow-restrictive than the flow path through the bullet passage, making the suppressor the path of least resistance. Most of the length of the suppressor is backward from the muzzle, minimizing forward extension. Sound is reflected internally. Aperture placement maximizes sound reduction with minimal gas flow restriction. This suppressor design allows gases to flow unimpeded through the suppressor.

BRIEF DESCRIPTION OF THE DRAWINGS

The invention is explained in the following description in view of the drawings that show.

GLOSSARY

Axis, axial: Respectively along or parallel to the centerline of the gun bore.

Closely fits without contact: This refers to aperture clearance for a bullet at the front of the bullet passage in the suppressor. It includes diametric clearance 5-18% greater than the gun bore diameter. For example a diametric clearance of about 1 mm for bore diameters from 5.56 mm to 10 mm falls within this range.

Flow aperture area: The aperture area of a gas flow path at its most flow-restrictive barrier. When the path traverses multiple apertures through a given barrier along the path, the flow aperture area is the combined areas of the apertures in that barrier. For example the flow aperture area between the inner and outer chambers is the combined areas of the apertures in the inner shell, which is the wall between these two chambers.

Longitudinal: Aligned with the length of the gun barrel.

Longitudinal line of sight: A straight line parallel to the bore of the gun barrel.

Proximal, distal: Relatively closer to or farther from the gun barrel respectively.

Transverse: Unless otherwise specified, this means in a plane substantially normal to the length of the barrel.

DETAILED DESCRIPTION OF THE INVENTION

Figure 1:
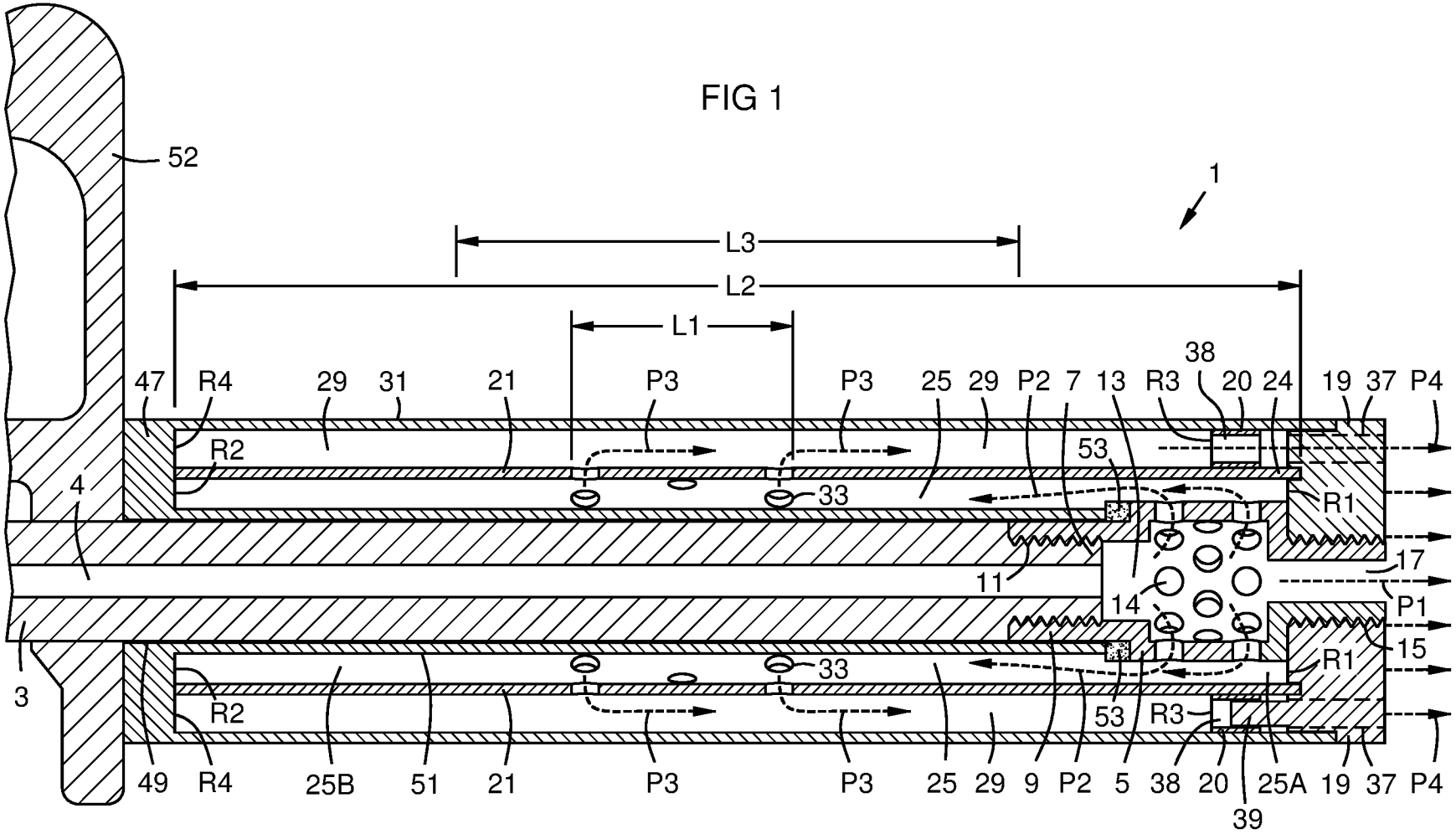
FIG. 1 is a side sectional view of a suppressor on a gun barrel in accordance with aspects of the invention taken on a vertical plane through the centerline of the barrel.

FIG. 1 is a sectional view of a suppressor 1 mounted on a barrel 3 of a firearm. A conduit 5 of the suppressor extends forward from the muzzle 7. The back end 9 of the conduit has internal threads 11 engaging external threads on the muzzle. The conduit has a bullet passage 13 for bullets to pass from the barrel bore 4 through the conduit, preferably without contact. The front end or exit 17 of the bullet passage closely fits the diameter of the bullet without contact. This minimizes propellant gas venting to the atmosphere via the bullet exit instead of going through the suppressor. An inner shell 21 has a front end 24 sealed around the front end of the conduit, for example by abutting a front plate 19 attached to the conduit by threads 15 or other means. The inner shell has a back end that extends backward over the barrel, forming a continuous inner annular chamber 25 with a first portion 25A around the conduit and a second portion 25B longer than the first portion around a front portion of the barrel.

A first gas path P1 through the bullet passage 13, 17 exits the front end of the conduit. A second gas path P2 is provided by apertures 14 through sides of the conduit 5 between the bullet passage 13 and the inner chamber 25. The second gas path may have a flow aperture area at least 6 times greater than the aperture area of the bullet exit 17 at the front end of the conduit. This relatively larger aperture area causes most of the propellant gas and noise to pass from the bullet passage 13 to the inner chamber 25 in preference to exiting to the atmosphere via the bullet passage. An outer chamber 29 is formed by an outer shell 31 that surrounds the inner shell. A third gas path P3 is provided by apertures 33 extending over a 1/10 to 1/3 proportion L1 of the length L2 of the inner shell 21 and located within the middle half L3 of the length of the inner shell. The third gas path may have an aperture area of at least the aperture area of the second gas path P2. A fourth gas path P4 is provided by apertures 37 at the front end of the outer shell, for example through the front plate 19 as shown, to vent the outer chamber to the atmosphere. The fourth gas path P4 may have an aperture area of at least the aperture area of the second gas path P2. Thus the overall gas path P2, P3, P4 through the suppressor may be at least 6 times less flow-restrictive than the gas path P1.

A sound reflector R1, R2, R3, R4 is provided at the front and back ends of the inner chamber 25 and the outer chamber 29. These reflectors may be transverse hard plates. A line of sight is provided between the front and back reflectors of each chamber, causing multiple longitudinal acoustic reflections and cancellations. Preferably, no longitudinal lines of sight are provided from the back reflector R2, R4 of either chamber 25, 29 to the atmosphere, forcing the sound to reflect many times, thus diffracting the sound while not impeding gas flow.

The line of sight between reflectors R1, R2 in chamber 25 and between reflectors R3, R4 in chamber 29 is preferably unobstructed, with no baffles between the front and back reflectors, as shown. Preferably the flow path within each chamber 25 and 29 is unreduced in cross section from end to end in the flow direction. The flow direction in the inner chamber 25 is from front to back, and in the outer chamber 29 it is from back to front. Preferably the chamber geometry allows a geometric projection of each reflector onto the opposite reflector of the same chamber without the projection being shaded by intervening suppressor elements. Alternately, each reflector R3, R4 of at least one of the chambers 29 can be projected onto the opposed reflector of the same chamber without the projection being shaded by intervening suppressor elements, and at least one reflector R1, R2 of the other chamber 25 can be projected onto the opposed reflector of the other chamber 25 without the projection being shaded by intervening suppressor elements in a flow direction P2 of the other chamber 25. Each reflector R1, R2, R3, R4 may be a stationary plane surface. Each chamber should maintain at least 70% or 80% of its cross sectional area from end to end to minimize flow delay and maximize acoustic reflections. In other words at least 70% or 80% of an acoustic reflection plane of each reflector in each chamber can be geometrically projected onto the opposed reflector in the same chamber unshaded by intervening suppressor elements.

Minimizing the flow delay minimizes both the propellant gas back pressure and heating of the suppressor. These benefits are especially important in fully automatic firing of military rifles. A gun manufacturer tested the present suppressor. It allowed a normal design cycling rate of the gun, and greatly reduced suppressor heating. Both of these benefits were in strong contrast to another tested suppressor at the same test session.

The back ends of the inner and outer chambers may be sealed by a back plate 47 forming the back reflectors R2, R4. The back plate has a central opening 49 to receive the gun barrel 3, and may include forward extending sleeve 51 that tightly receives the gun barrel. A slip-fit washer 53 may be provided instead of, or in addition to, the sleeve 51 to seal the inner chamber 25 from the atmosphere and prevent backward flash around the barrel opening 49. The washer 53 may be made of a semi-flexible heat-tolerant material such as polyimide for example, and/or other materials such as steel, copper, or flexible graphite, including composite materials. The sleeve may be made of the same material as the back plate, such as metal. Alternately, the sleeve may be made of a softer material, such as a high temperature plastic, to avoid scratching the barrel. Optionally, the sleeve may include one or more split rings or O-rings to elastically grip the barrel. For a tapered barrel the sleeve may be designed to compress around the barrel when the suppressor is screwed onto the muzzle threads.

Optionally, the suppressor may be of a length that presses the back end of the suppressor against an abutment on the barrel, such as a ring clamp or boss for a gunsight 52 or an added ring clamp. In this case, tightening of the threaded connections 11, 15 causes lengthwise compression of the suppressor and lengthwise tension on the front end of the barrel, which reduces flexing in addition to the mass added by the suppressor.

The relatively unrestricted flow of gas paths P2-P4 provide a path of least resistance through the suppressor. This minimizes back pressure that would otherwise cause gas reflux into the gun barrel and gas system. In the illustrated embodiment for example the conduit 5 has twenty four apertures 14, the inner shell 21 has thirty apertures 33, and the front gas path P4 has 12 apertures. These apertures for example may be about the same diameter as the bore. This provides an aperture area for each of the gas paths P2, P3, and P4 that is at least 6 or 10 times greater than that of gas path P1. Other aperture shapes may be used. In a preferred embodiment the chambers 25, 29 have no gas path to the atmosphere except path P4 through the front of the outer chamber as designed or backwards through the bullet passage 17, and the path of least resistance is through the front of the outer chamber.

The conduit 5 may be just long enough to provide the specified relatively unrestrictive aperture area for the second gas path P2 from the bullet passage 13 to the inner chamber 25. The chambers 25, 29 are disposed largely or mostly backward of the muzzle to minimize the forward extension of the suppressor. For example, the present suppressor may extend about 2 inches (5 cm) or less in front of an M16 rifle muzzle, which is no more than a simple muzzle brake such as the A2.

In one embodiment, the sound reflector R3 at the front end of the outer chamber 29 comprises a first plurality of apertures 37 open to the atmosphere in the front plate 19, a second plurality of apertures 38 in a transverse second plate or ring 20 behind the front plate between the inner and outer shells 21, 31, and a space between the front plate and the aperture ring at least 6 times less flow-restrictive than the front end 17 of the bullet passage. The first and second plurality of apertures 37, 38 are offset from each other, blocking all longitudinal lines of sight between the back reflector R4 in the outer chamber and the atmosphere, forcing multiple reflections. A pin 39 may extend from the front plate 19 into the transverse ring 20 or vice versa to rotationally index the two aperture sets relative to each other, setting the aperture offset. The pin 39 may extend from one plate 19 into an aperture 38 of the other plate as shown. However, other indexing means may be used as later shown to avoid blocking one of the apertures with the pin.

Figures 2, 3:
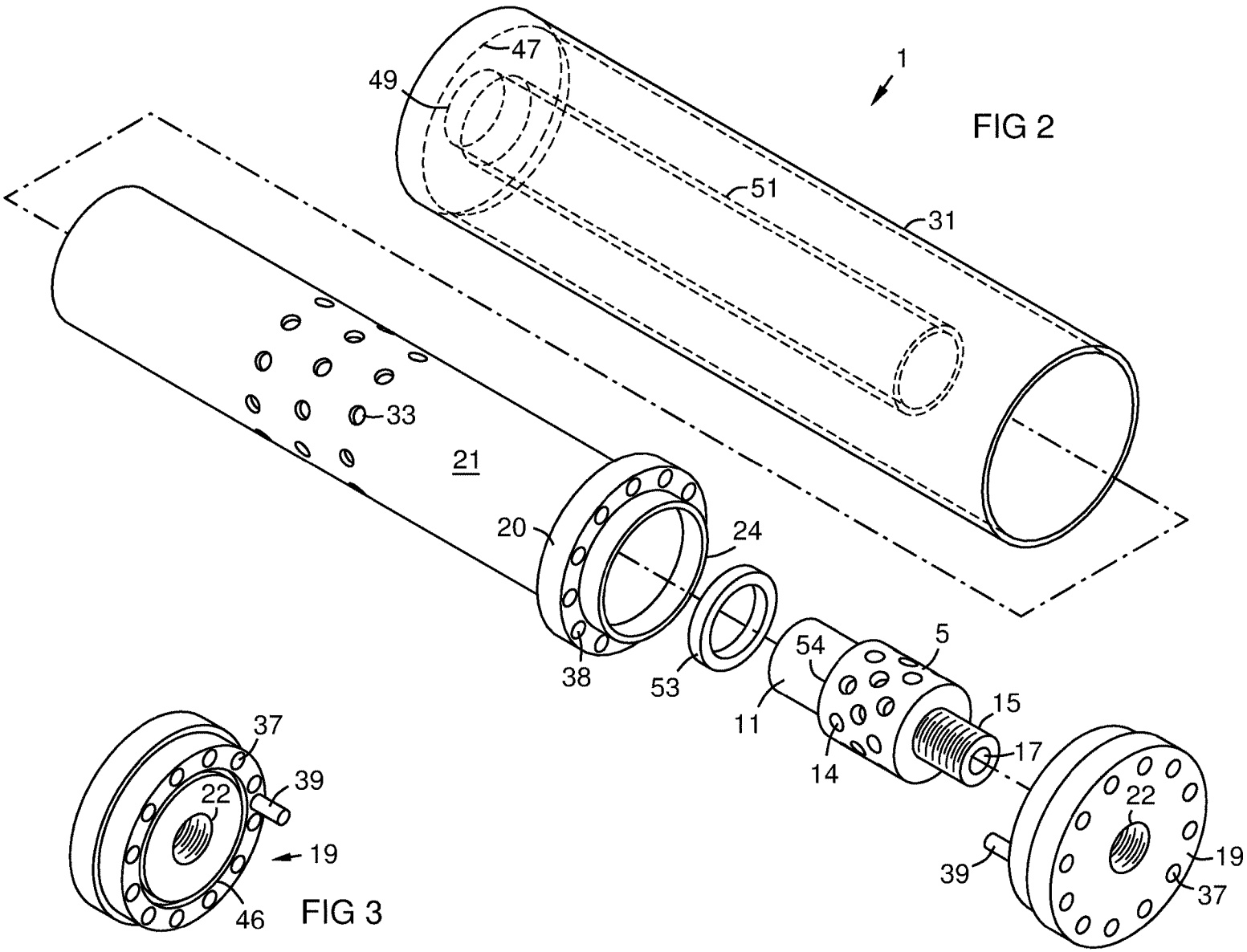
FIG. 2 is an isometric top/left/front view of the suppressor of FIG. 1.
FIG. 3 is an isometric top/right/back view of the front plate of FIG. 2.

FIG. 2 is an isometric exploded view of the suppressor of FIG. 1, showing the conduit 5, with apertures 14, an internally threaded portion 11 for attachment to the muzzle, and a forward-extending threaded boss 15 for attachment to the front plate 19 via a threaded hole 22. The outer shell 31 is shown with dashed hidden lines to illustrate the inner sleeve 51 that closely fits the gun barrel (not shown). The suppressor may be modular as shown to facilitate manufacturing and assembly. It also enables using the same front plate 19, inner shell 21, and outer shell 31 for a range of different barrel/bore diameters via interchangeable conduits 5 that fit the different barrels. To provide a tight fit of the opening 49 on different barrels, a slip-fit washer 53 may be provided in a set of custom sizes to fit each barrel and abut the central opening 49 or sleeve 51. The sleeve 53 may extend forward to press the slip-fit washer 53 against a rim 54 on the conduit 5, forming a seal between them that prevents the propellant gas from reaching the outer surface of the barrel. Alternately or additionally, the inner sleeve 51 may be replaced with a split ring (not shown) in an annular retention channel around the opening 49. Radially oriented set screws in the back plate 47 can tighten the split ring on the barrel. Alternately or additionally, the back plate 47, or a central portion thereof, may be removable and interchangeable for different barrel diameters and shapes. The front rim 24 of the inner shell 21 may fit within an annular groove 46 in the back side of the front plate as seen in FIG. 3. The back end of the inner shell 21 may extend to contact the back plate 47, closing the back end of the inner chamber 25.

In a modular embodiment, the inner shell 21 and/or outer shell 31 can be interchanged with alternate shells by or for the end user. For example, alternate shells of different materials such as steel, aluminum, titanium, and ceramic matrix composite may be offered to provide selectable mass and acoustics characteristics. The outer shell 31 may be offered with barrel accessory mounts for lights, sighting equipment, or infrared designators, may have an infrared reducing paint or other radiant barrier or other modifications required by the end user. An example ceramic coating is Cerakote® by NIC Industries. The inner shell 21 may be offered in different materials and/or with different configurations of gas path apertures 33 for higher or lower sonic signatures and different frequency responses optimized for different guns and ammunition.

Figure 4:
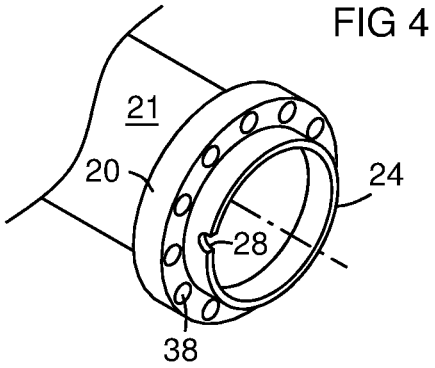
FIG. 4 is an isometric top/left/front view of an embodiment of the front end of the inner shell with an indexing notch.

FIG. 4 is an isometric view of the front end of the inner shell 21 in an embodiment with an indexing notch 28 in the front rim 24 that engages a corresponding fill (not shown) in the annular groove 46 seen in FIG. 3. This notch 28 is an alternative to the pin 39 shown in FIG. 3 for rotational indexing of the apertures 38 of the aperture plate or ring 20 to rotationally offset them from the apertures 37 of the front plate 19. The notch 28 does not block any of the apertures 38 as may occur with the pin 39 of FIG. 3.

In an alternate embodiment not shown, the sound reflector at the front end of the outer chamber 29 may be unperforated. The gas may exit to the atmosphere radially through apertures around the front end of the outer shell 31. Optionally, these radial apertures may be limited to left and right side portions of the front end of the outer shell, avoiding upward and downward gas jets. This prevents upward jets from blocking the sighting line, and avoids downward jets raising dirt from the ground when firing from a low position. This embodiment reduces recoil by redirecting most forward momentum of the propellant gas radially. More or larger apertures may be provided in the top left and right sides of the front end of the outer shell than in the bottom left and right sides to partially compensate for barrel rise during recoil.

The acoustic effectiveness of this suppressor may be due to multiple reflective sound cancellations in the chambers 25, 29 and the aperture 33 placement L1 in the inner sleeve being located at a node of a standing wave in the inner chamber 25 where some of the sound waves cancel. The result is an effective sound suppressor with minimal backpressure.

Embodiments of the present invention shown and described herein are provided by way of example. Variations and substitutions may be made without departing from the invention. Accordingly, it is intended that the invention be limited only by the appended claims.

The invention claimed is:

1. A suppressor for a firearm, the suppressor comprising:

a bullet passage in a conduit that mounts to a muzzle of a barrel of the firearm;

an inner shell that forms an inner chamber around the conduit and around a front portion of the barrel when the suppressor is mounted on the muzzle;

an outer shell that forms an outer chamber around the inner chamber, each said chamber comprising a front end and a back end;

a transverse stationary sound reflector at the front and back end of each said chamber providing opposed sound reflectors in each chamber;

a line of sight between the front and back sound reflectors of each said chamber, wherein each chamber is unreduced in cross sectional area between the opposed reflectors thereof in a flow direction therein, minimizing delay of a propellant gas flow through the suppressor;

no longitudinal line of sight from the back sound reflector of either of said chambers to the atmosphere; and a gas path from the bullet passage through sides of the conduit to the inner chamber, thence to the outer chamber, thence through an atmospheric exit at the front end of the outer chamber;

wherein the gas path is at least 6 times less flow-restrictive than the front end of the bullet passage.

2. The suppressor of claim 1, further comprising a geometry that allows a projection of each reflector onto the opposed reflector of the same chamber without the projection being shaded by intervening suppressor elements.

3. The suppressor of claim 2, wherein the gas path comprises apertures through the inner shell that admit gas between the inner and outer chambers only over 1/10 to 1/3 of a lengthwise proportion of the inner shell located within a middle half of a length of the inner shell.

4. The suppressor of claim 3, wherein the sound reflector at the front end of the outer chamber comprises a front plate with a first plurality of apertures open to the atmosphere, a transverse ring with a second plurality of apertures spaced behind the front plate between the inner and outer shells, and a flow area between the front plate and the transverse ring that is at least 6 times less flow-restrictive than the front end of the bullet passage, wherein the first and second plurality of apertures are offset from each other, blocking all longitudinal lines of sight between the back reflector in the outer chamber and the atmosphere.

5. The suppressor of claim 4 provided as a modular assembly comprising the following parts:

a) a back plate closing a back end of the outer shell except for a central opening in the back plate to receive the barrel of the firearm;

b) the transverse ring of apertures affixed to or integral with the inner shell and disposed proximate and behind a front rim of the inner shell;

c) the front plate comprising a back side with an annular groove that receives the front rim of the inner shell; and d) a rotational indexing device on the back side of the front plate that cooperates with a respective indexing device on the inner shell to rotationally offset the apertures of the front plate from the apertures in the transverse ring.

6. The suppressor of claim 5 wherein the conduit further comprises a back end with internal threads for engaging external threads on the muzzle, and a front end with a threaded boss for engaging internal threads in the front plate.

7. The suppressor of claim 6, further comprising a set of alternate conduits that are interchangeable with the conduit in the suppressor to accommodate a range of firearm barrels of different outer diameters and bore diameters; and a set of slip-fit washers of a semi-flexible heat tolerant material, said slip-fit washers respectively sized to fit the barrels and abut the central opening, sealing the inner chamber from a backward gas path to the atmosphere around the barrel.

8. The suppressor of claim 7, further comprising a set of alternate back plates or central portions of the back plate in the suppressor that are interchangeable in the suppressor to accommodate firearm barrels of different sizes and shapes, each back plate comprising a forward extending sleeve that fits a respective one of the barrels and presses the slip-fit washer against a rim on the conduit, blocking propellant gas from reaching the outer surface of the barrel when the suppressor is mounted on the barrel.

9. The suppressor of claim 7, further comprising:

a set of inner shells that are interchangeable with the inner shell of the suppressor and provide at least one of: an alternate material or an alternate configuration of the gas path apertures in the inner shell; and a set of outer shells that are interchangeable with the outer shell of the suppressor and provide at least one of: an alternate material, a mount for a gun muzzle accessory, or a radiant barrier.

10. A suppressor for mounting on a barrel of a firearm, the suppressor comprising:

a conduit that mounts to the barrel and extends forward from a muzzle thereof;

a bullet passage in the conduit for a bullet of the firearm to pass from a bore of the barrel through the conduit without contact;

the bullet passage comprising an aperture at a front end of the conduit having 5-18% greater diameter than the bore diameter;

an inner shell comprising a front end sealed around the front end of the conduit, and a back end that extends around the barrel, forming a continuous inner annular chamber with a first portion around the conduit and a second portion longer than the first portion around a front portion of the barrel when the suppressor is mounted on the barrel;

a first gas path through the bullet passage exiting the front end of the conduit;

a second gas path through sides of the conduit between the bullet passage and the inner chamber, the second gas path having a flow aperture area at least 6 times greater than a flow aperture area of the bullet passage at the front end of the conduit;

an outer annular chamber comprising an outer shell that surrounds the inner shell;

a third gas path comprising apertures over 1/10 to 1/3 of a lengthwise proportion of the inner shell and located within a middle half of a length of the inner shell, the third gas path having a flow aperture area at least 6 times greater than the flow aperture area of the bullet passage at the front end of the conduit;

a fourth gas path on the front end of the outer shell, venting the outer chamber to the atmosphere, the fourth gas path having a flow aperture area at least 6 times greater than the flow aperture area of the bullet passage at the front end of the conduit; and a sound reflector at front and back ends of both the inner chamber and the outer chamber, providing opposed sound reflectors in each said chamber, a line of sight between the front and back sound reflectors of each chamber, and no longitudinal lines of sight from the back sound reflector of either of said chambers to the atmosphere;

wherein least 70% of an acoustic reflection plane of each reflector in each chamber can be geometrically projected onto the opposed reflector in the same chamber unshaded by intervening suppressor elements.

11. The suppressor of claim 10, wherein each reflector of at least one of the chambers can be geometrically projected onto the opposed reflector of the same chamber without the projection being shaded by intervening suppressor elements, and at least one reflector of the other chamber can be geometrically projected onto the opposed reflector of the other chamber without the projection being shaded by intervening suppressor elements in a flow direction of the other chamber.

12. The suppressor of claim 10, wherein the sound reflector at the front end of the outer chamber comprises first and second transverse aperture plates, each aperture plate comprising a respective plurality of apertures, the apertures of the first aperture plate being offset from any longitudinal line of sight through the apertures of the second aperture plate; and a gas flow space between the plates, wherein the fourth gas flow path passes through and between the transverse aperture plates.

13. The suppressor of claim 11, wherein the sound reflector at the front end of the outer chamber comprises a flow aperture area at least as great as the flow aperture area of the third gas path.

14. The suppressor of claim 10, wherein the back ends of the inner and outer chambers are closed by a back plate comprising a central opening with a forward extending sleeve that receives the gun barrel and seals both chambers at the back ends thereof from the atmosphere.

15. The suppressor of claim 10, wherein, the atmospheric exit path of least resistance for compressed propellant gas in the inner chamber is via the third and fourth gas paths.

16. The suppressor of claim 10, wherein the inner chamber has no immediate gas exit path to the atmosphere, and the fourth gas path is the only immediate gas exit path between the outer chamber and the atmosphere.

17. The suppressor of claim 10, further comprising a front plate of the suppressor that is removably attached to the front end of the conduit; and further comprising a set of alternately sized conduits that are interchangeable with the conduit of the suppressor to adapt the inner and outer shells to a range of gun barrels of different diameters.

18. A suppressor for mounting on a barrel of a firearm, the suppressor comprising:

a conduit comprising a back end that threads onto the muzzle of the barrel, a middle portion extending forward of the muzzle, and a bullet passage admitting the bullet from the muzzle to a bullet exit hole at a front end of the conduit;

an inner shell attached to and sealed around the front end of the conduit, extending over and behind the muzzle to surround a front portion of the barrel, forming an inner chamber around the conduit and the front portion of the barrel;

an outer shell attached to a front end of the inner shell, surrounding the inner shell, and forming an outer chamber between the inner and outer shells;

a gas flow path between the bullet passage and the inner chamber, thence to the outer chamber, thence from a front end of the outer chamber to the atmosphere, the gas flow path having a flow aperture area at a most flow-restricted barrier thereof at least 6 times greater than a flow aperture area of a front end of the bullet passage;

the gas flow path comprising apertures in the inner shell that admit the gas flow path between the inner and outer chambers only over 1/10 to 1/3 of an intermediate lengthwise portion of the inner shell within a middle half of a length of the inner shell; and the front end of the outer chamber comprising a sound reflector that admits the gas flow path therethrough without admitting any longitudinal line of sight between a back end of the outer chamber and the atmosphere;

wherein each said chamber maintains at least 70% of a cross sectional area of the chamber between front and back ends thereof.

19. The suppressor of claim 18, wherein the sound reflector comprises first and second transverse plates at the front end of the outer chamber in parallel spaced relation to each other, each said plate comprising a circular array of holes, wherein the holes of the first plate are rotationally misaligned with the holes of the second plate eliminating any longitudinal line of sight that passes through both plates.

20. The suppressor of claim 18 provided as a modular assembly comprising the following parts:

a) a back plate closing a back end of the outer shell except for a central opening in the back plate to receive the barrel of the firearm;

b) a transverse ring comprising gas path apertures affixed to or integral with the inner shell and disposed proximate and behind a front rim of the inner shell;

c) a front plate sealing the inner and outer shells around the front end of the conduit, the front plate comprising exit apertures for the gas path from the outer chamber to the atmosphere; and d) the gas exit apertures of the front plate being offset from the gas path apertures in the transverse ring, eliminating any longitudinal line of sight between the outer chamber and the atmosphere;

e) wherein the conduit further comprises a back end with internal threads for engaging external threads on the muzzle, and a front end with a threaded boss for engaging internal threads in the front plate.

* * * * *